US008180578B2

(12) United States Patent
Stone et al.

(10) Patent No.: US 8,180,578 B2
(45) Date of Patent: May 15, 2012

(54) MULTI-COMPONENT MULTI-PHASE FLUID ANALYSIS USING FLASH METHOD

(75) Inventors: Terry Wayne Stone, Hampshire (GB); James S. Nolen, Santa Fe, NM (US)

(73) Assignee: Schlumberger Technology Corporation, Sugar Land, TX (US)

( * ) Notice: Subject to any disclaimer, the term of this patent is extended or adjusted under 35 U.S.C. 154(b) by 528 days.

(21) Appl. No.: 12/370,670

(22) Filed: Feb. 13, 2009

(65) Prior Publication Data

US 2009/0210174 A1 Aug. 20, 2009

Related U.S. Application Data

(60) Provisional application No. 61/030,134, filed on Feb. 20, 2008.

(51) Int. Cl.
*G01N 3/00* (2006.01)

(52) U.S. Cl. ..... 702/24; 703/10; 73/61.44

(58) Field of Classification Search ..... 702/24, 702/45; 703/6, 9–10
See application file for complete search history.

(56) References Cited

U.S. PATENT DOCUMENTS

| | | | | |
|---|---|---|---|---|
| 6,041,263 | A * | 3/2000 | Boston et al. | 700/32 |
| 6,106,561 | A * | 8/2000 | Farmer | 703/10 |
| 6,108,608 | A | 8/2000 | Watts | |
| 7,716,029 | B2 * | 5/2010 | Couet et al. | 703/10 |
| 2002/0177986 | A1 | 11/2002 | Moeckel et al. | |

FOREIGN PATENT DOCUMENTS

| | | | |
|---|---|---|---|
| GB | 2357145 | A | 6/2001 |
| GB | 2445043 | A | 6/2008 |
| WO | WO2007146679 | A2 | 12/2007 |

OTHER PUBLICATIONS

Rajeev K. Agarwal, "Multiphase multicomponent isenthalpic flash calculations", Reservoir Engineering, May-Jun. 1991, Col. 30, No. 3, pp. 69-75.*

Joáo A.P. Coutinho et al., "Predictions of three-phase regions in $CO_2$-oil mixtures", Journal of Petroleum Science and Engineering 12 (1995) 201-208, http://www.sciencedirect.com/science/article/pii/0920410594000445.*

A.Sh. Ramazanov, A.V. Parshin, Temperature Distribution in Oil- and Water-Saturared Reservior With Account of Oil Degassing, Oil and Gas Business, 2006, p. 1-16, Http://Www.Ogbus.Ru/Eng/Authors/Ramazanov/Ramazanov_1e.Pdf.*

Ghorai, et al, "Numerical Modeling of Three-Phase Stratified FLow in Pipes", Chemical Engineering Science, Dec. 1, 2005, pp. 6637-6648, vol. 60, XP005042112.

Naccache, P.F., "A Fully-Implicit Thermal Reservoir Simulator", Society of Petroleum Engineers, SPE 37985, pp. 97-103 (1997).

(Continued)

*Primary Examiner* — Mohamed Charioui
*Assistant Examiner* — Alexander Satanovsky
(74) *Attorney, Agent, or Firm* — Lam Nguyen

(57) ABSTRACT

A method of analyzing phase transitions of fluid in an oilfield operation of an oilfield. The method includes determining phase boundaries of a multi-component multi-phase system based on geophysical parameters associated with the oilfield, predicting an amount of at least one fluid component in a liquid fluid phase of the multi-component multi-phase system by solving a set of flash equations based on phase boundaries, and performing the oilfield operation based on the predicted amount.

17 Claims, 8 Drawing Sheets

OTHER PUBLICATIONS

Michelsen, Michael L., "State Function Based Flash Specifications", Fluid Phase Equilibria, (1999) Elsevier Science B.V., pp. 617-626.

Agarwal, Rajev K.; Li, Yau-Kun; Nghiem, Long X.; Coombe, Dennis A.; "Multiphase Multicomponent Isenthalpic Flash Calculations" Journal of Canadian Petroleum Technology, May-Jun. (1991), vol. 30, No. 3, pp. 69-75.

Michelsen, Michael L., "Some Aspects fo Multiphase Calculations", Fluid Phase Equilibria, 30, Elsevier Science V.V., (1986) pp. 15-29.

Brantferger, K.M.; Pope, G.A.; Sepehrnoori, K.; "Development of a Thermodynamically Consistent, Fully Implcit, Equation-of-State, Compositional Steamflood Simulator", Society of Petroleum Engineers, SPE 21253, pp. 471-480 (1991).

* cited by examiner

MULTI-COMPONENT MULTI-PHASE FLUID ANALYSIS USING FLASH METHOD

CROSS REFERENCE TO RELATED APPLICATION

This application claims priority pursuant to 35 U.S.C. §119 (e), to the filing date of U.S. Patent Application Ser. No. 61/030,134 entitled "ISENTHALPIC K-VALUE FLASH AND ENVELOPE METHOD," filed on Feb. 20, 2008, which is hereby incorporated by reference in its entirety.

BACKGROUND

While high quality petroleum reservoirs have been successfully explored and exploited for producing oil and gas, large reservoirs are increasingly difficult to find and many face the termination of primary recovery where large portions of the hydrocarbons remain trapped within the reservoir. In addition, many reservoirs lack sufficient natural forces to be produced by primary methods from the very beginning. Recognition of these facts has led to the development and use of many enhanced oil recovery (EOR) techniques. Some of these techniques involve injection of steam into the reservoir to force hydrocarbons towards and into a production well. While many reservoir simulators are based on an isothermal liquid model, the high temperature process of steam injection requires a thermal model to be included in the simulators where high temperature gradients and their impact on the system are modeled.

SUMMARY

A method of analyzing phase transitions of fluid in an oilfield operation of an oilfield. The method includes (i) determining phase boundaries of a multi-component multi-phase system based on geophysical parameters associated with the oilfield by determining a first temperature at which a first liquid phase associated with the phase boundaries disappears, determining a second temperature at which a second liquid phase associated with phase boundaries disappears, where the first liquid is present when the second liquid disappears, where the second temperature is determined based on the first temperature and is lower than or equal to the first temperature, and determining a third temperature at which the gaseous phase appears, where the third temperature is determined based on the second temperature and is lower than or equal to the second temperature, where determining the first, second, and third temperatures are by using pressure and temperature dependent empirical equilibrium multi-phase mole fraction ratios (K-values) of the multi-component multi-phase system, (ii) predicting an amount of an at least one fluid component in a liquid fluid phase of the multi-component multi-phase system by solving a set of flash equations based on phase boundaries, and (iii) performing the oilfield operation based on the predicted amount.

Other aspects of the multi-component multi-phase fluid analysis using flash method will be apparent from the following description and the appended claims.

DETAILED DESCRIPTION

Figure 1:
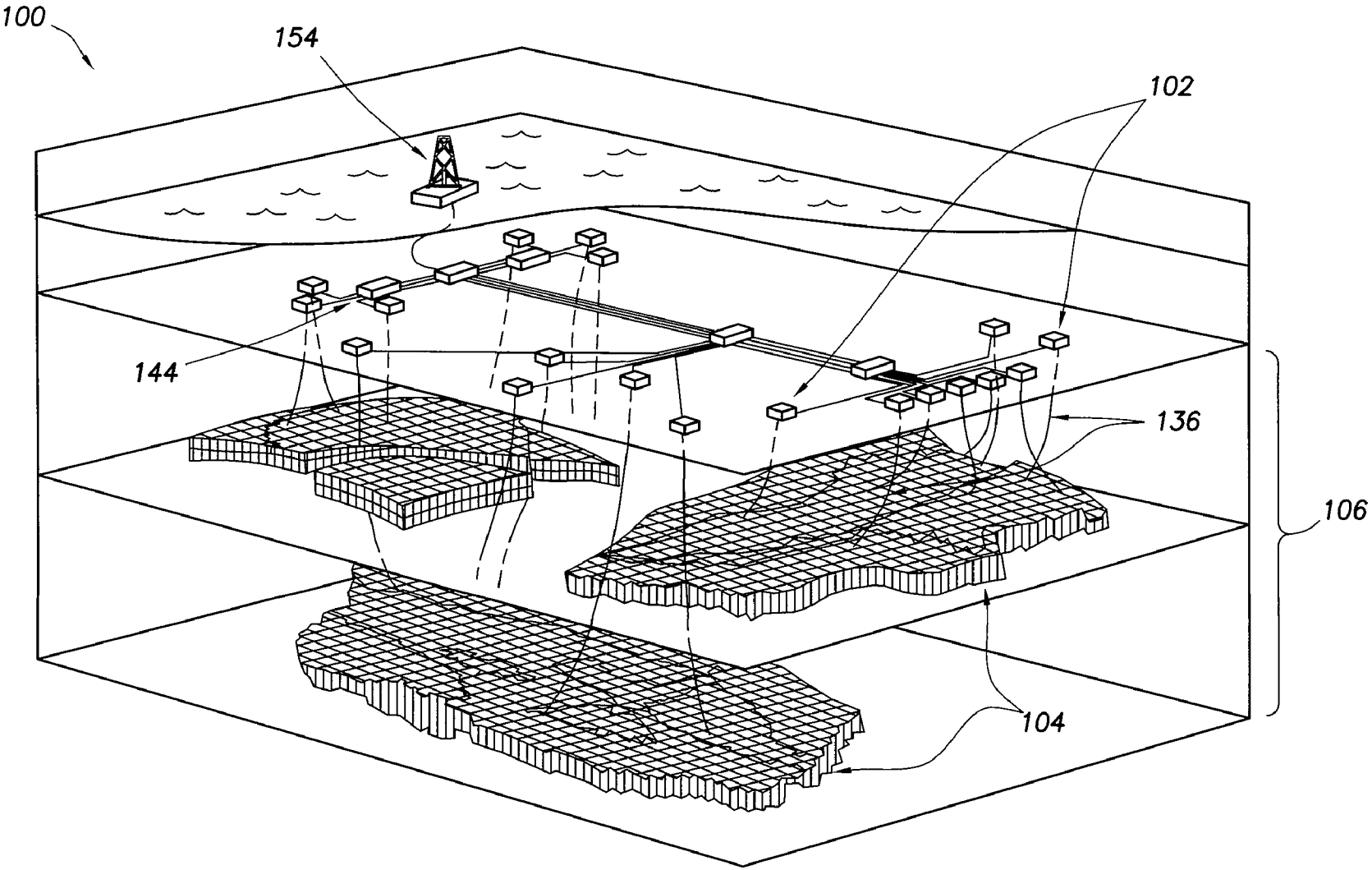
FIG. 1 shows an example oilfield activity having a plurality of wellbores linked to an operations control center.

Embodiments of the multi-component multi-phase fluid analysis using flash method are shown in the above-identified figures and described in detail below. In describing the embodiments, like or identical reference numerals are used to identify common or similar elements. The figures are not necessarily to scale and certain features and certain views of the figures may be shown exaggerated in scale or in schematic in the interest of clarity and conciseness.

Aspects of the multi-component multi-phase fluid analysis using flash method may be used to analyze material phase transitions in any number of industries. One such industry is the oil and gas industry. FIG. 1 depicts an overview of an example containing various aspects an oilfield activity which may be performed by the oil and gas industry. Briefly, an oilfield activity may take many forms including operations performed before any drilling occurs, such as, for example, exploration, analysis, etc. In addition, an oilfield activity may include activities occurring after drilling, for example, well work over and intervention, as well as storage, transport and refining of hydrocarbons. Furthermore, an oilfield activity may also include activities performed during drilling.

Turning to FIG. 1, an oilfield activity (100) is depicted including machinery used to extract hydrocarbons, such as oil and gas, from subterranean formations (106) (e.g., a reservoir (104)). The oilfield configuration of FIG. 1 is not intended to limit the scope of the multi-component multi-phase fluid analysis using flash method. Part or all of the oilfield may be on land and/or sea. Also, while a single oilfield with a single processing facility and a plurality of wellsites is depicted, any combination of one or more oilfields, one or more processing facilities and one or more wellsites may be present. Further, a central processing facility (154) may assist in collecting data and making decisions to enhance operations in the oilfield. Data may include, for example, measurements of bottom hole pressure and tubing head pressure.

As shown in FIG.1, the oilfield activity (100) includes a number of wells. Specifically, the oilfield activity (100) includes multiple wellsites (102) having equipment that forms a wellbore (136) in the earth, which may use steam injection to produce a hydrocarbon (e.g., oil, gas, etc.); rely on a gas lift to produce a hydrocarbon; or produce a hydrocarbon on the basis of natural flow. The multiple wellsites (102) deliver production fluids (e.g., hydrocarbon produced from their respective wells) through one or more surface networks (144). The surface networks (144) include tubing and control mechanisms for controlling the flow of fluids from one or more of the wellsites (102) to the central processing facility (154).

The surface networks (144) may include production manifold for collecting multiple streams and outputing the streams to a gas and oil separator. Upon receipt of the production fluids by the gas and oil separator, the gas and oil separator separates various components from the fluids, such as produced water, produced oil, and produced gas, respectively to a water disposal well, an oil storage, and a compressor station.

Oil storage may transfer oil via an oil export pipeline of the surface networks (144). Similarly, the compressor station may use a gas export pipeline to transfer gas. Finally, the compressor station may process gas as an injection gas.

Generally speaking, fluid such as hydrocarbon material in a portion of the oilfield described with respect to FIG. 1 above (e.g., wellsites (102), surface network (144), production manifold, gas and oil separator, oil storage, compressor station, oil export pipeline, etc., or any combinations thereof) may be modeled as a multi-component multi-phase system (or portion thereof). In one or more embodiments, the phase transitions of the multi-component multi-phase system may be analyzed using equipment in the control center (154) described with respect to FIG. 1 above. The components in the multi-component multi-phase system include fluids such as water and hydrocarbon where the hydrocarbon may include volatile hydrocarbon (vhc) and non-volatile hydrocarbon (nvhc). The multiple phases may include a liquid water phase, a liquid hydrocarbon (hereafter the term "liquid hydrocarbon" is used interchangeably with the terms "oil", or "liquid oil") phase, and a gaseous phase (i.e., vapor phase). As is known in the art, at sufficiently low temperatures, only the liquid water phase and the liquid oil phase exist in a phase state of the multi-component multi-phase system. As the temperature is raised to a phase transition temperature (referred to as T3 throughout this document), the gaseous phase appears and the phase state includes the liquid water phase, the liquid oil phase, and the gaseous phase. As the temperature is further raised to a higher phase transition temperature (referred to as T2 throughout this document), a first liquid phase, which is one of the liquid water phase or the liquid oil phase, turns to a vapor and the phase state includes the remaining liquid phase and the gaseous phase. As the temperature is further raised to an even higher phase transition temperature (referred to as T1 throughout this document), the remaining liquid phase also turns to a vapor and the phase state only includes the gaseous phase. In some multi-component multi-phase systems, non-condensable hydrocarbons (nchc) may exist in a gaseous state but do not condense to liquid.

In one or more embodiments, the analysis of the phase transitions of the multi-component multi-phase system may be performed with various levels of approximation in a mathematical representation of a reservoir or other portions of the oilfield (100). For example, a full reservoir simulation model represents the reservoir with a large number of grid blocks. The multi-component multi-phase system may correspond to a simulation grid block of a reservoir simulator. In other examples, proxy models (e.g., a tank model proxy or a lookup table proxy of the full reservoir simulation model) may be used to provide a simplified representation of the reservoir and, accordingly, may be solved more efficiently. The multi-component multi-phase system may correspond to the entire reservoir represented by these proxy models. As is known to those skilled in the art, a proxy model is a component that behaves like ordinary models from the perspective of a simulator in that the proxy model returns data to a simulation engine of the simulator based on the simulation inputs, however the returned data from the proxy model is not calculated in the same manner as an ordinary model. For example the returned data may be generated by a heuristic engine or retrieved from a pre-determined data structure storing empirical data.

In one or more embodiments, modeling the oilfield (100) (e.g., using reservoir simulation) may include obtaining geophysical parameters such as initial pressures, fluids, and energy in place as well as models of the phase enthalpies and pressure/temperature K-value correlations for each of the hydrocarbon components. For example, initial values of various parameters may be acquired from the analysis of core samples collected from the oilfield. More specifically, core samples may be collected from the bottom of the well, at other points in the surface network or at the process facilities. Further, water properties and K-values may be determined from built-in steam tables. As an example, in a surface separator that is part of the process facilities, representative samples of both the liquid and the gas streams are collected. These samples, which have been collected under pressure, are experimentally stabilized to atmospheric conditions by a single flash process. During this process, the fluid may separate into two or more phases. This allows for the determination of the volume of the gas in the samples. Further, the aforementioned process allows additional information about the liquids to be obtained. For example, the liquids may be allowed to settle to the bottom of the flash chamber after which the liquid is drained and weighed in order to calculate its density. The aforementioned volumes and density data at various pressures and temperatures, moles of hydrocarbons and water in the phases (phase splits) and compositions of the phases are used in mathematical correlations of density, K-Values, and enthalpies of the system or components in the system. This multi-component multi-phase fluid analysis may be accomplished by regression analysis using a solution of the Isenthalpic K-Value Flash and Envelope Method against the experimentally determined phase splits and temperature. Details of the Isenthalpic K-Value Flash and Envelope Method are described with respect to FIGS. 3-4 below, which may be performed using the system described with respect to FIG. 2 below.

Using the initial values of various geophysical parameters described above as the initial conditions of the multi-component multi-phase system (or the system), the simulator predicts (forward in time) various parameters of the reservoir in increments of time called time steps. In one or more embodiment, to proceed to a subsequent time step, Isenthalpic K-Value Flash and Envelope Method is applied/performed in each simulation grid block (e.g., of the reservoir (104)), in each simulation well node (representing e.g., the wellsite (102)) and in each simulation surface network node (representing e.g., the gathering network (144)) according to algorithms described in more details below. This Isenthalpic K-Value Flash and Envelope Method provides the simulator the distribution of components amongst the phases which in turn allows the calculation of densities, volumes, and phase enthalpies, as well as flow rates of the phases and other physical quantities to be performed. The speed of execution and correctness of the Isenthalpic K-Value Flash and Envelope Method improves the overall reliability of the reservoir simulation prediction. Furthermore, the simplicity of the equations used in the Isenthalpic K-Value Flash and Envelope Method allows fast overall convergence of the mass and energy conservation equations in the simulator.

Specifically, using geophysical parameters such as a pressure P, component feed mole fractions $z_i$ (the subscript i represents a component in the system, e.g., water where, i=w, or a component of hydrocarbon, where i ∈ vhc, i=nvhc, or i=nchc), and a total enthalpy h, the Isenthalpic K-Value Flash and Envelope Method determines how many phases are present in the system. Further, the Isenthalpic K-Value Flash and Envelope Method may be used to determine the moles of each component in each phase based on a model of volatility of each component to be determined by pressure and temperature dependent K-values. As is known in the art, the model of volatility is represented by the equation below.

$$y_i = K_i(P,T) \cdot x_i$$

Here, $y_i$ represents the mole fraction of a component i in the gaseous phase, $x_i$ represents the mole fraction of the component i in a base phase (i.e., the liquid phase of the same component), and $K_i$ is an empirical equilibrium K-value (or multi-phase mole fraction ratio) for the component i.

The phase transition temperatures $T_1$, $T_2$, and $T_3$ described above are independent of the amount of heat or enthalpy in a fluid sample (i.e., the fluid in the multi-component multi-phase system) but are uniquely determined by the pressure P, component feeds $z_i$ and equilibrium K-values $K_i$. A by-product of the phase transition temperature calculation is the amount of vapor V, liquid oil L and liquid water W that exist at each of these transitions. These are also known as the phase splits. Once these temperatures and phase splits are known, then phase transition enthalpies can be constructed from the individual phase enthalpies $h_{oil}$, $h_{water}$, $h_{gas}$. Finally by comparing the total enthalpy of the fluid sample, $h_{tot}$, to these phase transition enthalpies, the phase state of the system is known. These phase transition enthalpies are also called the enthalpy phase envelope of the system. For a given phase state, an energy balance equation together with molar balance equations can be solved to determine the temperature and vapor split V corresponding to the system enthalpy. This last element is called the flash or VLE calculation. More details of the Isenthalpic K-Value Flash and Envelope Method are described in the method flow charts in FIGS. 3 and 4 below, which may be performed using the system described with respect to FIG. 2 below.

Figure 2:
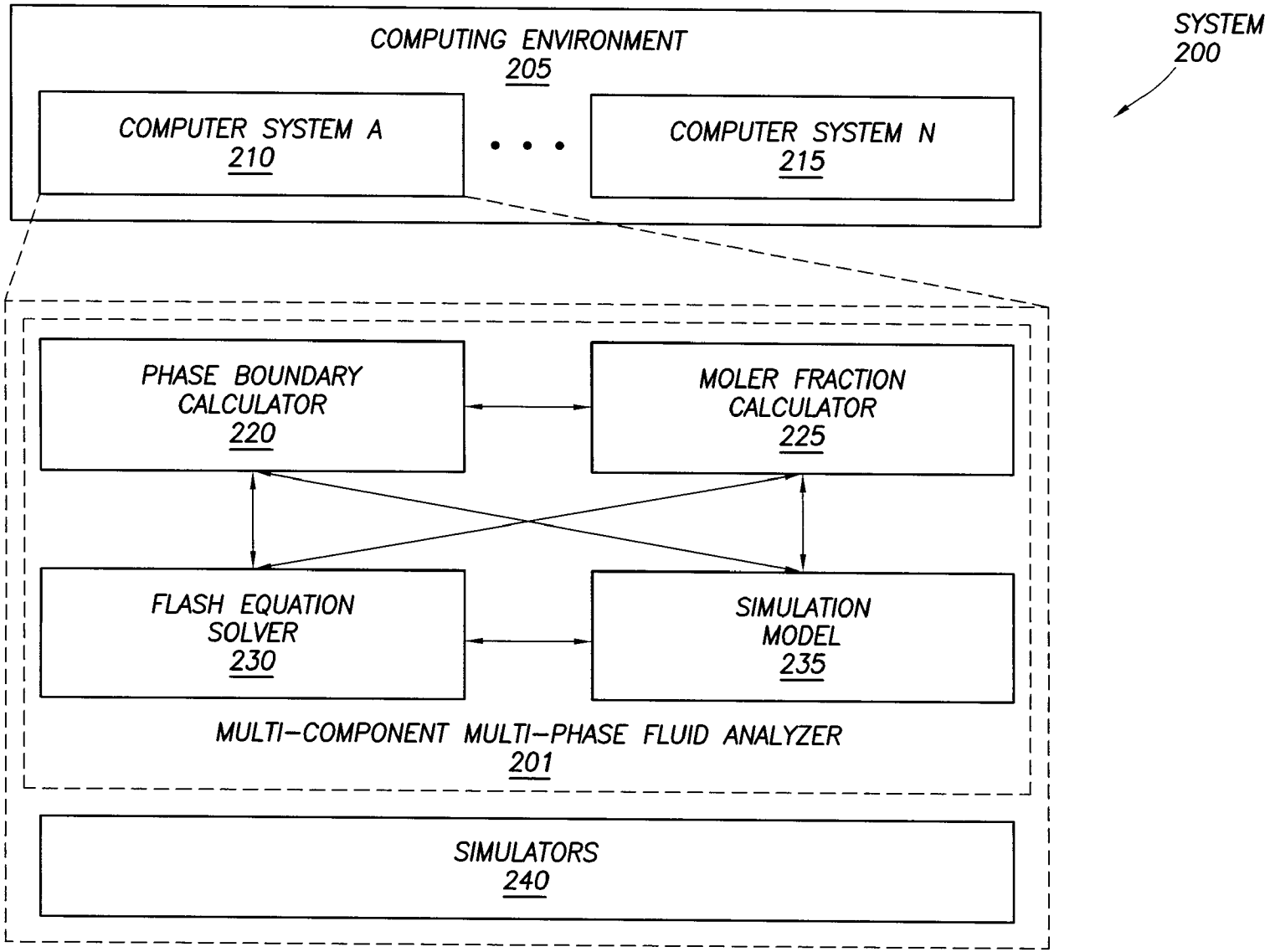
FIG. 2 shows a system for performing multi-component multi-phase fluid analysis in accordance with one or more embodiments.

FIG. 2 shows a diagram of a system (200) in accordance with one or more embodiments. Specifically, FIG. 2 shows a diagram of a computing environment (205) in accordance with one or more embodiments. In one or more embodiments, one or more of the modules shown in FIG. 2 may be omitted, repeated, and/or substituted. Accordingly, embodiments of the oilfield emulator should not be considered limited to the specific arrangements of modules shown in FIG. 2. In one or more embodiments, the computing environment (205) may be implemented in one or more surface unit such as the central processing facility (154) described with respect to FIG. 1 above.

In one or more embodiments, the computing environment (205) may include one or more computer systems (e.g., computer system A (210), computer system N (215), etc.) configured to perform oilfield operations such as simulation-related tasks. In one or more embodiments of the oilfield emulator, the computer system(s) (e.g., 210, 215) may be web servers, embedded systems (e.g., a computer located in a downhole tool), desktop computers, laptop computers, personal digital assistants, any other similar type of computer system, or any combination thereof.

Specifically, in one or more embodiments, one or more of the computer systems (e.g., 210, 215) may include the Multi-component Multi-phase Fluid Analyzer (201) and simulators (240) (e.g., a reservoir simulator, a network simulator, etc.). The Multi-component Multi-phase Fluid Analyzer (201) is shown to include a Phase Boundary Calculator (220), a Moler Fraction Calculator (225), a Flash Equation Solver (230), a Simulation Model (235), and Simulators (240). In one or more embodiments, the aforementioned components (i.e., 220, 225, 230, 235, 240) may be located in a single computer system (e.g., 210, 215), distributed across multiple computer systems (e.g., 210, 215), or any combination thereof. In one or more embodiments, each of the aforementioned components (i.e., 220, 225, 230, 235, 240) may include one or more software modules, one or more hardware modules, or any combination thereof. Further, in one or more embodiments, the aforementioned components (i.e., 220, 225, 230, 235, 240) may be configured to communicate with each other via function calls, application program interfaces (APIs), a network protocol (i.e., a wired or wireless network protocol), electronic circuitry, any other similar type of communication and/or communication protocol, or any combination thereof.

In one or more embodiments, the Phase Boundary Calculator (220) is configured to determine phase boundaries of a multi-component multi-phase fluid system (e.g., fluid in a portion of an oilfield) based on geophysical parameters associated with the fluid in the portion of the oilfield using pressure and temperature dependent empirical equilibrium multi-phase mole fraction ratios (K-values) of the fluid. More details of determining phase boundaries of the multi-component multi-phase fluid system are described with respect to FIGS. 3 and 4 below.

In one or more embodiments, the Moler Fraction Calculator (225) is configured to predict an amount of oil in a liquid oil phase in the portion of the oilfield by solving a set of flash equations based on the phase boundaries determined by the Phase Boundary Calculator (220) described above. More details of predicting the amount of oil in the liquid oil phase are described with respect to FIGS. 3 and 4 below.

In one or more embodiments, the Flash Equation Solver (230) is configured to solve Flash equations at phase transition points of the multi-component multi-phase fluid system. More details of solving Flash equations at phase transition points are described with respect to FIGS. 3 and 4 below. In one or more embodiments, the Simulation Model (235) may be configured to be used by Simulators (240) for modeling oilfield operations.

Figure 3:
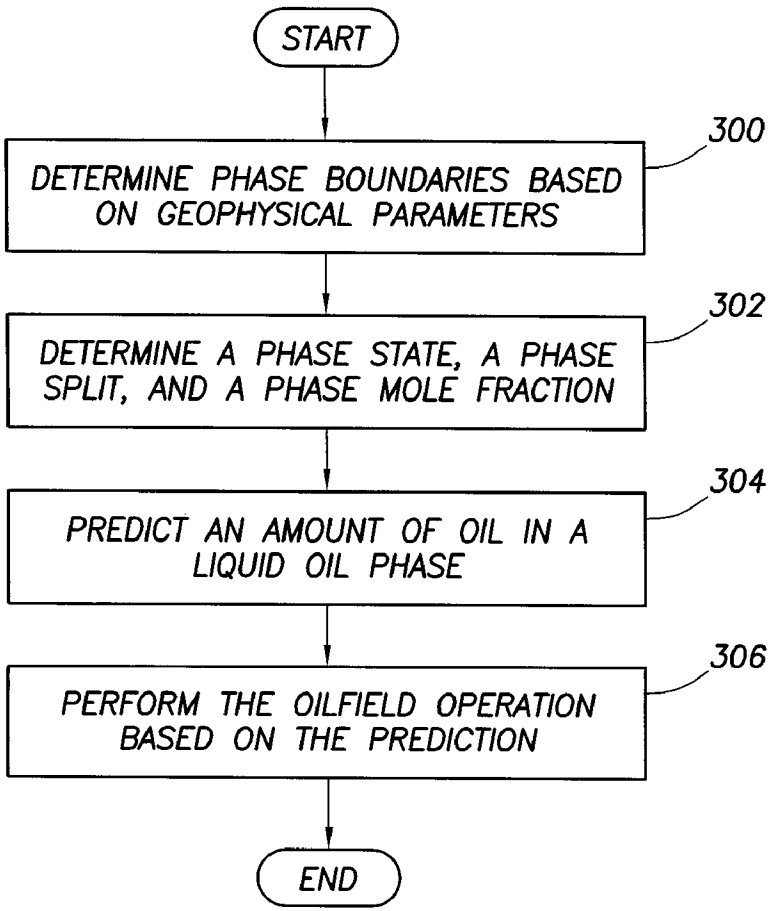
FIG. 3 and FIG. 4 are flowcharts depicting methods for multi-component multi-phase fluid analysis using flash method in accordance with one or more embodiments.
Figure 4:
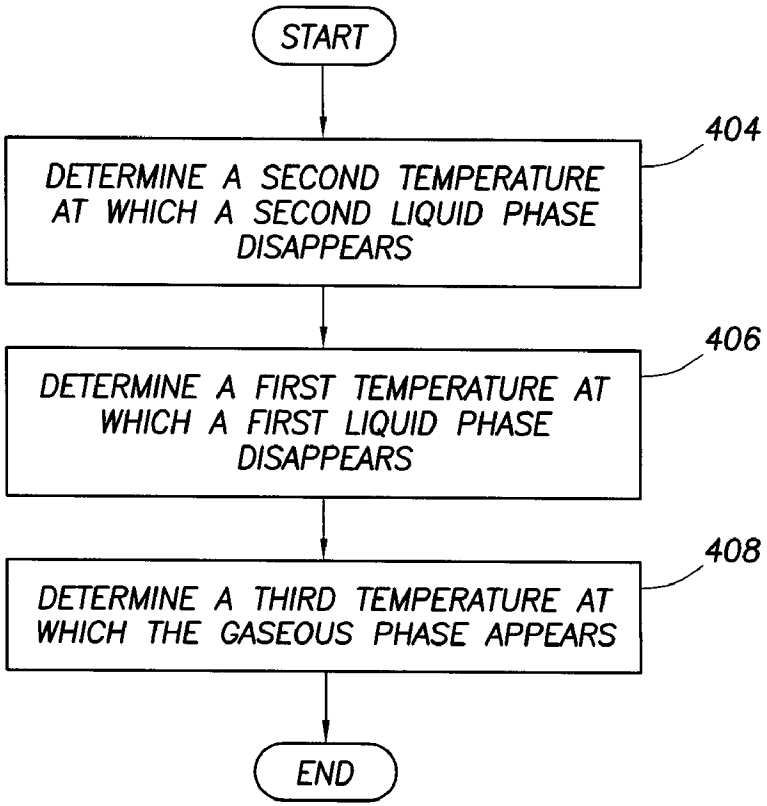

FIG. 3 and FIG. 4 are flowcharts depicting use of the Isenthalpic K-Value Flash and Envelope Method (or the Method) for performing oilfield operations in accordance with one or more embodiments. In one or more embodiments, one or more of the elements shown in FIG. 3 and FIG. 4 may be omitted, repeated, and/or performed in a different order. Accordingly, embodiments of the method should not be considered limited to the specific arrangements of elements shown in FIG. 3 and FIG. 4.

As shown in FIG. 3, there are two basic stages in the Method. First, the Phase Boundaries are determined based on the geophysical parameters (300). In one or more embodiments, this stage may be performed using the Phase Boundary Calculator described with respect to FIG. 2 above. Then the flash or VLE calculation is performed using the knowledge of the Phase Boundaries (302). In one or more embodiments, this stage may be performed using the Flash Equation Solver described with respect to FIG. 2 above. Based on these results of 302 and 310 basic stages, the amount of hydrocarbon in a liquid phase is predicted, for example as a function of time by the simulation operations performed in the control center (154) depicted in FIG. 1 above (304). In one or more embodiments, this stage may be performed using the Moler Fraction Calculator described with respect to FIG. 2 above. The oilfield operation is then performed based on these results, for example, to perform planning or diagnostic activities according to the amount of hydrocarbon in the liquid phase (306).

As shown in FIG. 4, there are three elements of the block (302) for determining the phase boundaries, i.e., elements (404), (406), and (408), which also correspond to the phase transition temperatures $T_1$, $T_2$, and $T_3$ described above. The details of the elements (404), (406), and (408) are described in detail below.

Determining Phase Boundaries

In this section, the algorithms described below are used to calculate boundaries for appearance or disappearance of phases. For example, the phase boundaries to be considered are appearance of vapor at $T_3$, disappearance of liquid water and disappearance of liquid oil at $T_1$ or $T_2$. Given a measured total fluid enthalpy (e.g., at a point in a well) denoted $h_{well}$, total mole fractions $z_i$, a total molar flow rate (i.e., total flow rate represented in the unit of moles) $Q_T$ and the flowing well pressure $P_{wf}$, a total fluid enthalpy $h_{tot}$ is defined as a weighted combination of the phase enthalpies, $h_{gas}$, $h_{oil}$ and $h_{water}$ in the equation below.

$$h_{tot}=V\cdot h_{gas}+L\cdot h_{oil}+W\cdot h_{water} \tag{1}$$

Phase enthalpies are functions of the component enthalpies and liquid and gas phase mole fractions $x_i$, $y_i$. These phase mole fractions, in turn, are functions of pressure and temperature dependent K-values, $z_i$ and phase splits L, V and W. Enthalpy equations as a function of pressure, temperature, and phase mole fractions, for example in the form of $H_i=H(P,T,y_i)$ or $H(P,T,x_i)$ are known in the art. The symbols H, P, T may be denoted in uppercase or lowercase based on the context known to one skilled in the art.

For a given pressure, phase transition enthalpies are computed at the phase boundaries using appropriate temperatures, phase splits, and phase mole fractions. Since enthalpy is monotonic in temperature, i.e.

$$\left.\frac{\partial h}{\partial T}\right|_P > 0,$$

these phase transition enthalpies are unique. The total system enthalpy is then compared to the phase transition enthalpies and the phase state is determined accordingly.

Calculating Phase Transition Enthalpies at Phase Boundaries in Block (302):

The following describes algorithms to calculate phase transition enthalpies for appearance of a gaseous phase, $H_{t,gas}$, disappearance of a water phase, $H_{t,wat}$, and disappearance of a liquid oil phase, $H_{t,oil}$. These algorithms may be used by the Phase Boundary Calculator described with respect to FIG. 2. In order to compute the phase transition enthalpies, temperatures are computed for the disappearance of the remaining liquid phase at $T_1$, the first disappearance of a first liquid phase at $T_2$, and appearance of the gaseous phase at $T_3$.

Element (404): Disappearance of the Remaining Liquid Phase

If there are no non-volatile hydrocarbons (nvhc, each nvhc component is represented by the subscript i) to prevent complete evaporation of the oil phase, the temperatures at which the water phase and the oil phase would disappear may be determined as follows:

$$T_w \text{ from } z_w = K_w(T) \tag{2}$$

$$T_o \text{ from } \sum_{i\in vhc}\frac{z_i}{K_{io}(T)} = 1 \tag{3}$$

Those skilled in the art will appreciate that the conventional notation shown in equations (2) and (3) is for summation over the group of volatile hydrocarbon components. This convention is used throughout this document. If water is the remaining liquid phase and has just disappeared with a rise in temperature, then the mole fraction of water in the gas phase, $y_w=K_w(T)\cdot x_w$ where $x_w=1$, is equal to the global mole fraction of water $z_w$ which gives equation (2). Similarly, equation (3) arises when water as a liquid phase has already disappeared and only a trace of liquid oil remains in the system (i.e., $L\rightarrow 0$). Consequently, the vapor mole fraction approaches unity, i.e., $V\rightarrow 1$, and the volatile hydrocarbon components in the liquid phase still sums to 1, hence equation (3).

Let $T_1$ represent the higher of the $T_w$ and $T_o$ as in equation (4) below.

$$T_1; =\max(T_w,T_o) \tag{4}$$

By definition, $T_1$ is the temperature at which the remaining liquid phase leaves the system.

If $T_1=T_w$, set $$H_{t,wat}=H_{gas}(P,T_1,y_i=z_i) \tag{5}$$

If $T_1=T_o$, and there are no non-volatile hydrocarbon components in the system, set $$H_{t,oil}=H_{gas}(P,T_1,y_i=z_i) \tag{6}$$

If there are non-volatiles in the system, set $$H_{t,oil}=\infty \tag{7}$$

Element (406): Disappearance of the First Liquid Phase

The case where oil disappeared first is described below. If $T_1=T_w$, then oil disappeared from the system first and at $T_2$ there is still some water in the system. Because liquid oil disappeared first, there are no non-volatile hydrocarbons present. Between $T_1$ and $T_2$, $$L = 0 \tag{8}$$

$$V = \frac{(1-z_w)}{(1-K_w)} \tag{9}$$

$$W = \frac{(z_w-K_w)}{(1-K_w)} \tag{10}$$

The numerator of equation (9) is the ratio of moles of hydrocarbon components to total moles. Because $K_w$ is the mole fraction of water in the gas phase, then the denominator of equation (9) is the ratio of moles of hydrocarbon in the gas phase to total moles of gas phase. Because L=0, moles of hydrocarbon in the gas phase are the total moles of hydrocarbon. Consequently, the ratio of numerator to denominator is moles of gas phase / total moles, which is the vapor phase split, V.

At $T_2$, $1\geqq z_w\geqq K_w$ because $T_2<T_1$ and $z_w=K_w(T_1)>K_w(T_2)$. Also at $T_2$, $$x_i = \frac{z_i}{K_{io}(T_2)\cdot V} = \frac{z_i(1-K_w(T_2))}{K_{io}(T_2)(1-z_w)},\ i\in vhc \tag{11}$$

The temperature $T_2$ is found by iterating $$\sum_{i\in vhc} x_i = 1.$$

It follows that $$\sum_i y_i = 1$$

Because $$\sum_{i\in vhc} y_i = \sum_{i\in vhc}\frac{z_i}{V} = \frac{(1-z_w-z_{nchc})}{V},\ y_w = K_w,\ y_{nchc} = \frac{z_{nchc}}{V} \tag{12}$$

and using the definition of V above.

A phase transition enthalpy for disappearance of oil can then be calculated as $$H_{t,oil}=V\cdot h_{gas}(p,T_2,y_i)+W\cdot h_{wat}(p,T_2) \tag{13}$$

The case where water disappeared first is described below. If $T_1=T_o$, then water disappeared first, and at $T_2$ there is still some oil in the system. Between $T_1$ and $T_2$, $$W=0 \tag{14}$$

At $T_2$, water has completely vaporized, hence $$y_w = \frac{z_w}{V} = K_w \text{ or } V = \frac{z_w}{K_w}$$

and L=1−V. Then $$x_i(T_2) = \frac{z_i \cdot K_w(T_2)}{K_w(T_2) - z_w(1 - K_{io}(T_2))},\ i \in vhc \tag{15}$$

and $T_2$ can be obtained by solving a Rachford-Rice equation $$\begin{aligned} 0 &= \sum_{i\in hc}(x_i - y_i) \\ &= -K_w(T_2) - \frac{z_{nchc}K_w(T_2)}{z_w} + \\ &\quad \sum_{i\in vhc}\frac{z_i K_w(T_2)(1-K_{io}(T_2))}{K_w(T_2) - z_w(1-K_{io}(T_2))} + \\ &\quad \frac{z_{nvhc}K_w(T_2)}{K_w(T_2) - z_w} \end{aligned} \tag{16}$$

This equation is chosen over solving either $$\sum_i x_i = 1 \text{ or } \sum_i y_i = 1$$

because there are circumstances where $$\sum_i y_i \cong 1$$

while $$\sum_i x_i$$

has good variation in temperature, or vice versa. Solving Rachford-Rice equations enables both of the above scenarios to be considered.

To aid in solving the above equations, temperatures may be found that bracket the solution. Because $$V = \frac{z_w}{K_w}$$

and $V \leqq 1-z_{nvhc}$, then $$K_w(T_2) \geq \frac{z_w}{(1 - z_{nvhc})}$$

and the above equations may be solved to give a lower bound on $T_2$. Also because $V \geqq z_W + z_{nchc}$, then $$K_w(T_2) \leq \frac{z_w}{z_w + z_{nchc}}$$

and the above equation may be solved to give an upper bound on $T_2$.

The phase transition enthalpy for disappearance of water may then be calculated as $$H_{t,wat}=L\cdot h_{oil}(p,T_2,x_i)+V\cdot h_{gas}(p,T_2,y_i) \tag{17}$$

Element (408): Appearance of Gas

Let $T_3$ be the temperature when gas first appears. If there are no non-condensable hydrocarbons in the system, $$W=z_w \tag{18}$$

$$L=1-z_w \tag{19}$$

and $T_3$ may be iterated from $$\sum_i y_i = 1,$$

which can be expressed as $$K_w(T_3) + \frac{1}{(1 - z_w)}\sum_{i\in vhc} K_{io}(T_3)\cdot z_i = 1 \tag{20}$$

If there are no volatile hydrocarbon components in the system, the above equation reduces to $T_3=T_{vap,wat}$ because of the Henry's law used for $K_w$. Oil phase mole fractions sum to 1 because $$\sum_{i\in hc} x_i = \sum_{i\in hc}\frac{z_i}{L} = \frac{(1 - z_w)}{L} = 1.$$

A phase transition enthalpy for appearance of gas may be calculated as $$H_{t,gas}=L\cdot h_{oil}(P,T_3,x_i)+W\cdot h_{wat}(P,T_3) \tag{21}$$

unless there are non-condensable components in the system in which case $$H_{t,gas}=-\infty \tag{22}$$

Determining Phase State, Phase Split, and Phase Mole Fraction Using Flash Equations in Block (310):

With knowledge of the phase state of the system, various simplifications may be made to solve the flash equations. For example, the two-phase and three-phase systems with a gaseous phase are considered below.

Gas-Oil System: $H_{t,wat} \leqq h_{tot} \leqq H_{t,oil}$

In this case, water as a liquid is not present and in this enthalpy range, equation (14) holds. To determine temperature and the vapor phase split, solve an equation similar to equation (16), $$0 = \sum_{i \in hc} (x_i - y_i) = -\frac{(z_w + z_{nchc})}{V} + \sum_{i \in vhc} \frac{z_i(1 - K_{io})}{1 - V(1 - K_{io})} + \frac{z_{nvhc}}{1 - V} \quad (23)$$

and it is known, $$V = \frac{h_{tot} - h_{oil}}{h_{gas} - h_{oil}} \quad (24)$$

If pressure and total composition are held constant, it follows that the phase compositions, $x_i$ and $y_i$, can be expressed as functions of T and V. Therefore, equations (23) and (24) are also functions of T and V only and may be solved simultaneously.

In a thermal compositional formulation, the oil and gas phase enthalpies are usually computed by a mole fraction weighted sum of the component enthalpies. These component enthalpies are frequently characterized by a specific heat, possibly a second order in temperature coefficient and heats of vaporization. Routinely, users select identical or similar coefficients for all components. In this case, the oil and gas phase enthalpies can simply and better be characterized as functions of pressure and temperature only (the pressure dependence often arising only from the water liquid/vapor enthalpies and/or an infrequently used Joule-Thompson coefficient). When all of the phase enthalpies may be characterized by (P,T) only, then equation (24) may be substituted into equation (23) to obtain a single equation in temperature.

Gas-Water System: $H_{t,oil} \leqq h_{tot} \leqq H_{t,wat}$

For this range of enthalpies, the oil phase is absent and equations (8)-(10) hold. A temperature may be found by solving $$0 = h_{tot} - \frac{(1 - z_w)}{(1 - K_w(T))} h_{gas}(T, y_i(T)) - \frac{(z_w - K_w(T))}{(1 - K_w(T))} h_{wat}(T) \quad (25)$$

In this gas-water state, the phase splits are only functions of temperature and sample composition.

Oil-Water-Gas System: $H_{t,gas} \leqq h_{tot} \leqq \min(H_{t,oil}, H_{t,wat})$ This is the three phase region. Solve a Rachford-Rice equation similar to (23)

$$\begin{aligned} 0 &= \sum_{i \in hc} (x_i, y_i) \\ &= -K_w(T) - \frac{z_{nchc}}{V} + \\ &\quad \sum_{i \in vhc} \frac{z_i(1 - K_{io}(T))}{1 - z_w - V(1 - K_w(T) - K_{io}(T))} + \\ &\quad \frac{z_{nvhc}}{1 - z_w - V(1 - K_w(T))} \end{aligned} \quad (26)$$

and it is known, $$h_{tot} = Vh_{gas} + [1 - V(1 - K_w) - z_w]h_{oil} + (z_w - VK_w)h_{water} \quad (27)$$

which may be solved simultaneously with (26) for T and V. For the special case where phase enthalpies are functions of pressure and temperature only, then (27) may be solved for V and substituted into (26) to obtain a single equation in temperature, T.

Starting Guess for a Oil-Water-Gas System with Traces of Non-Volatile Components Equations (26) and (27) may be difficult to solve. Problems often arise when traces of non-volatile components are present. The problem lies in converging the liquid oil phase split, L, whose magnitude is $\geqq z_{nvhc}$. To help solve these equations in this case, initial estimates for T and V may be obtained as follows:

Because $$L = 1 - z_w - V(1 - K_w) \geqq z_{nvhc} \quad (28)$$

then $$V \geqq (1 - z_w - z_{nvhc})/(1 - K_w(T)) \quad (29)$$

Use the equality in (29) for this starting estimate/value. Because the liquid phase split $L \rightarrow 0$, then $$y_i \rightarrow y_i(T) = \frac{z_i}{V} = \frac{z_i(1 - K_w(T))}{(1 - z_w - z_{nvhc})}.$$

the starting estimate/value in T and hence V is then obtained by solving an energy balance $$h_{well} = V(T) \cdot h_{well,gas}(T, y_i(T)) + (1 - V(T)) \cdot h_{well,water}(T) \quad (30)$$

This equation has good monotonic properties in the variable T and converges quickly.

It will be understood from the foregoing description that various modifications and changes may be made in the embodiments of the multi-component multi-phase fluid analysis using flash method without departing from its true spirit. For example, although two phases or three phases are considered in the examples given above, the Isenthalpic K-Value Flash and Envelope Method described can be extended to higher numbers of phases without deviating from its true spirit. In another example, although fluid composed of various hydrocarbon components is described in the example given above, one skilled in the art will appreciate the method disclosed may apply to any fluid composed of one or more components in any process other than the hydrocarbons in oilfield operations. For example, the method may be applied to a manufacturing process where a thermal fluid undergoes phase change (e.g., in a smelting plant where metal or plastic is liquefied and it is desired to know when the fluid may undergo a phase transition). Further, the elements of portions or all of the process may be repeated as desired. Repeated elements may be selectively performed until satisfactory results are achieved. For example, elements may be repeated after adjustments are made. This may be done to update the simulator and/or to determine the impact of changes made. The method may be applied to simulators or stand-alone analysis. Various combinations may be tried and compared to determine the best outcome. Adjustments to the oilfield simulation may be made based on the oilfield, the simulators, the arrangement, and other factors. The process may be repeated as desired.

Figure 5:
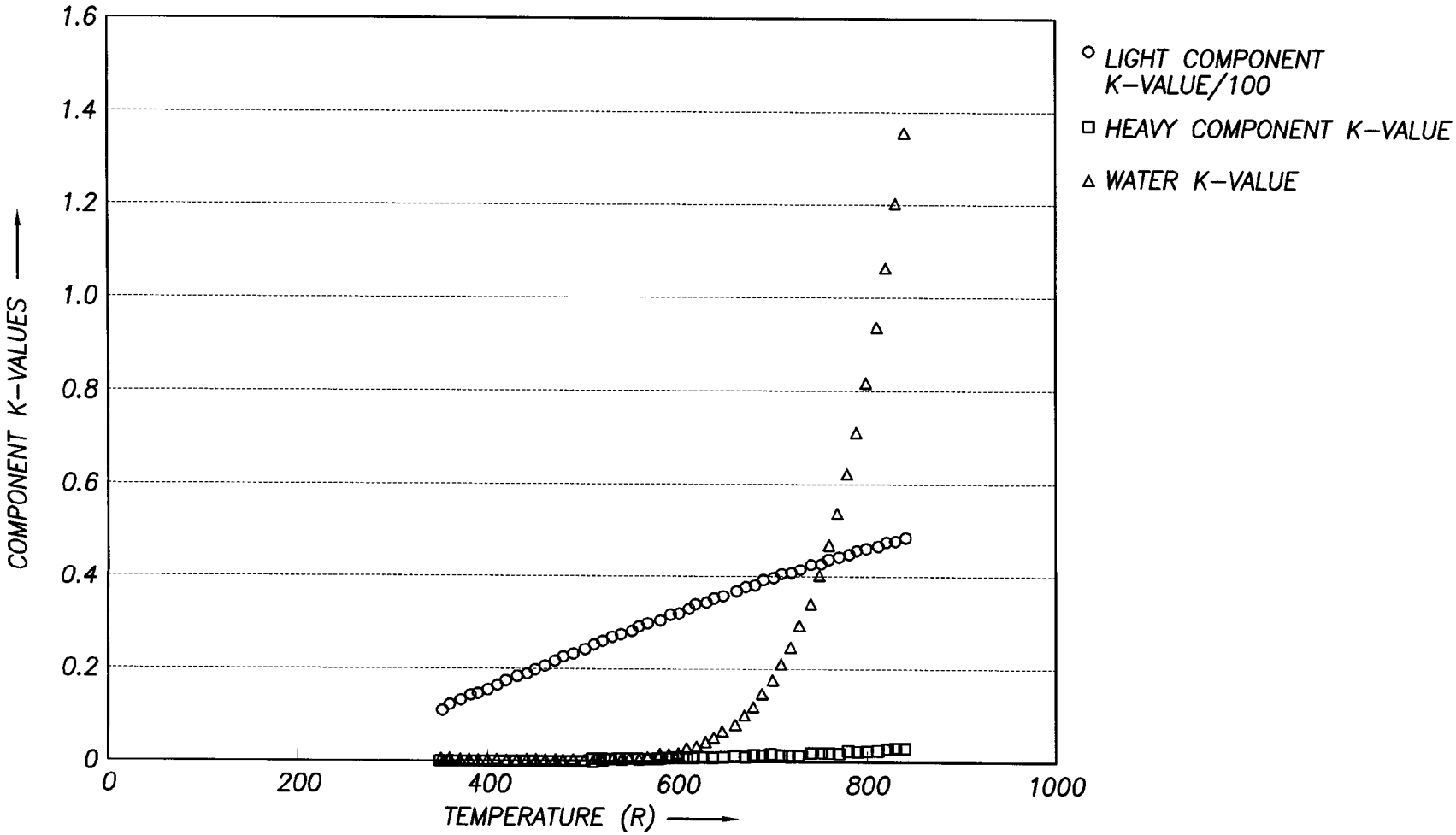
FIGS. 5-8 show an example of multi-component multi-phase fluid analysis in accordance with one or more embodiments.

An example is presented below in FIGS. 5-8 to illustrate convergence robustness of the multi-component multi-phase fluid analysis using flash method as described above. In this example, the multi-component multi-phase fluid includes two hydrocarbon components which are typical of a standard heavy oil fluid comprising a light, soluble methane-like component and a heavier but slightly volatile component. FIG. 5 shows plots of the component K-values including the water K-value modeled with the Henry's law mentioned above. TABLE 1 below presents the coefficients used for the Crookston correlation, as is known in the art, which models the hydrocarbon component K-values.

TABLE 1

| Example Data | | | | | |
|---|---|---|---|---|---|
| Input: | | | | | |
| P = 145 psia | | | | | |
| Z[0] = 0.0000004 (light) | | | | | |
| Z[1] = 0.0000092 (heavy) | | | | | |
| Z[W] = 0.9999904 (water) | | | | | |
| H = 402 Btu/lb-mole - Example 1a | | | | | |
| H = 8000 Btu/lb-mole - Example 1b | | | | | |
| K-Values - modelled with Crookston correlation | | | | | |
| $K(P, T) = \left(A + \frac{B}{P} + C \cdot P\right) \cdot e^{\frac{-D}{T-E}}$ | | | | | |
| Component | A | B | C | D | E |
| Light | 0 | 1368 | 0 | 481 | 0 |
| Heavy | 0 | 10 | 0 | 1616 | 13 |
| Phase Transition Temperatures | | | | | |
| $T_3$ = 492 R = appearance of gas | | | | | |
| $T_2$ = 813.5 R = oil disappearance | | | | | |
| $T_1$ = 815.35 R = water disappearance | | | | | |
| Transition Enthalpies | | | | | |
| $H_{t,gas}$ = 15 Btu/lb-mole | | | | | |

The input pressures and feed were chosen to demonstrate a state that is in transition and difficult to converge. Molar feed is primarily water with traces of hydrocarbon as seen in TABLE 1. Transition enthalpies shown in this table are calculated as discussed above. Comparison of the input total fluid enthalpy for this example with the transition enthalpies in TABLE 1 show that the state is oil-water-gas (OWG).

Figure 6:
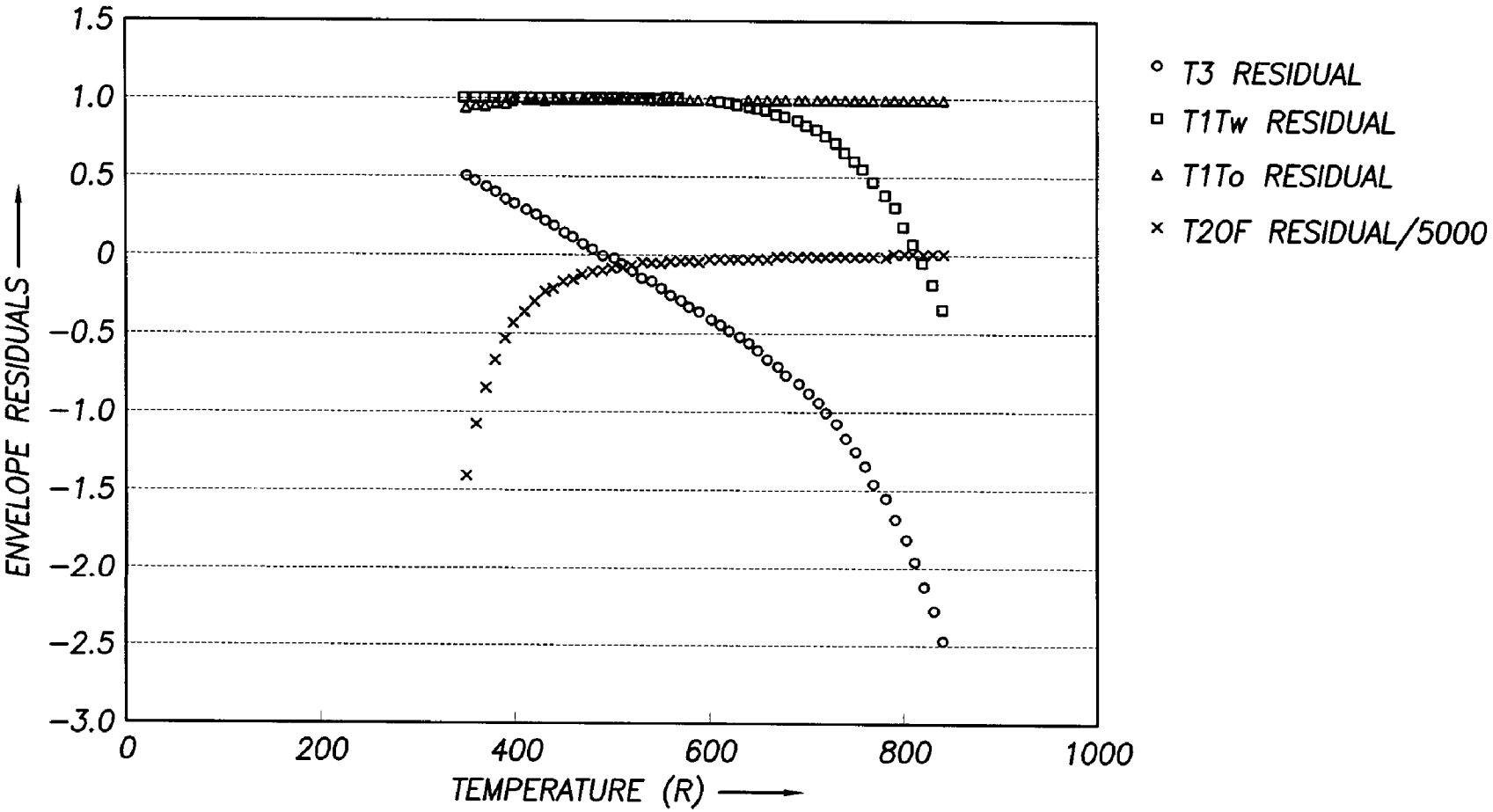

FIG. 6 shows the envelope residuals for this case. The residuals are dimensionless ratios of liquid component moles, for example moles of volatile hydrocarbon over moles of total oil phase for T1TO. The $T_3$ residual is determined using equation (20), the $T_1$ calculation for $T_w$ residual is determined using equation (2) and is labeled T1Tw in the Figure. The $T_1$ calculation for $T_o$ residual is determined using equation (3) and is labeled T1To and the residual for the $T_2$ calculation given that oil left the system first is determined using equation (11) and is labeled T2OF. Here, the residuals for T2OF is scaled by a factor of 5000 for clarity of illustration. The monotone behavior of $T_3$ residual indicates no convergence difficulties in this example, however in general (and especially when using the Crookston correlations) it may be S-shaped which requires a combined bisection/Newton method with damping on the temperature update. Robustness of the $T_1T_w$ calculation is essentially convergence of the $P_{sat,w}(T)$ curve that may be solved using standard Newton updates.

Figure 7:
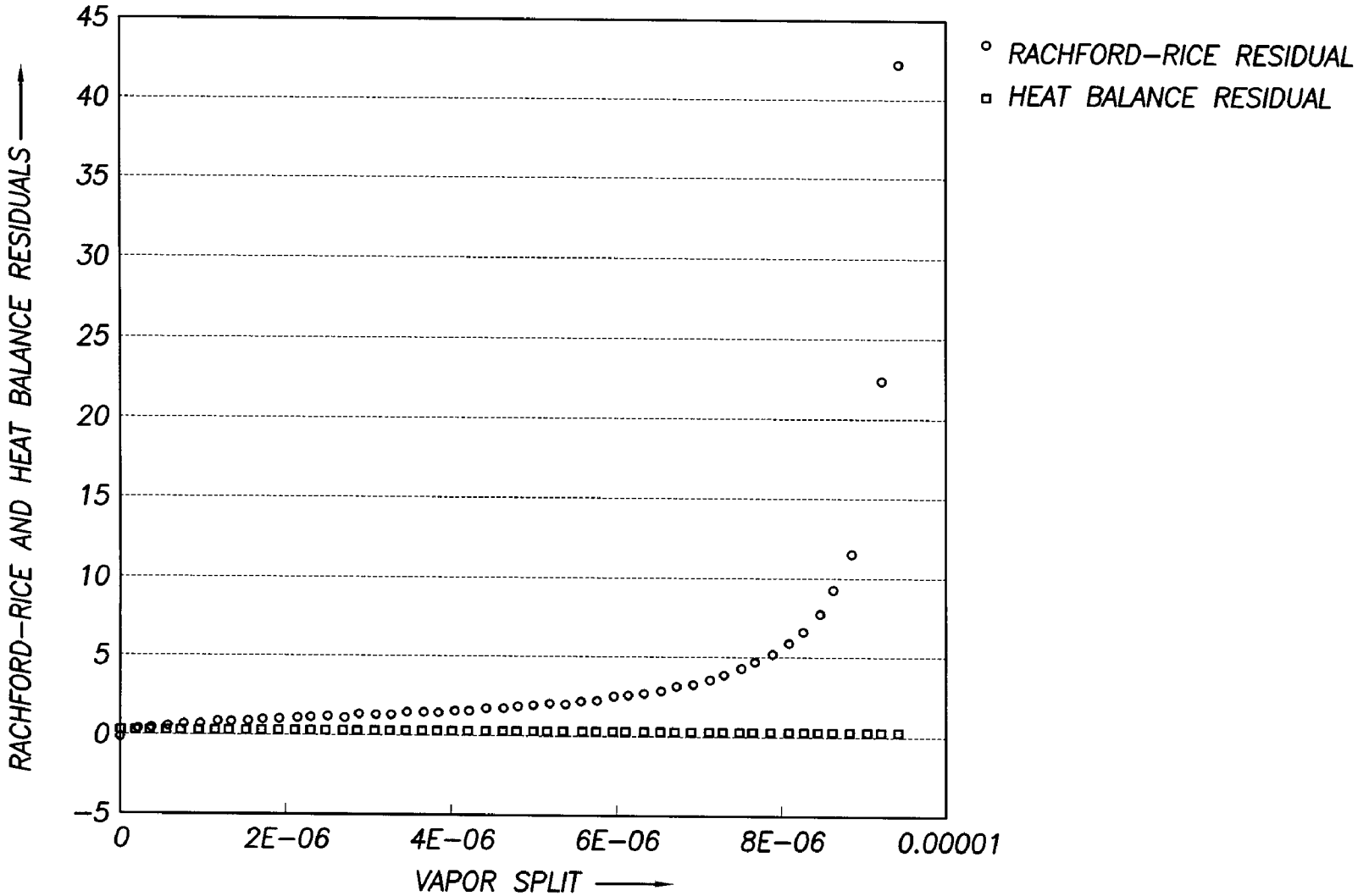
Figure 8:
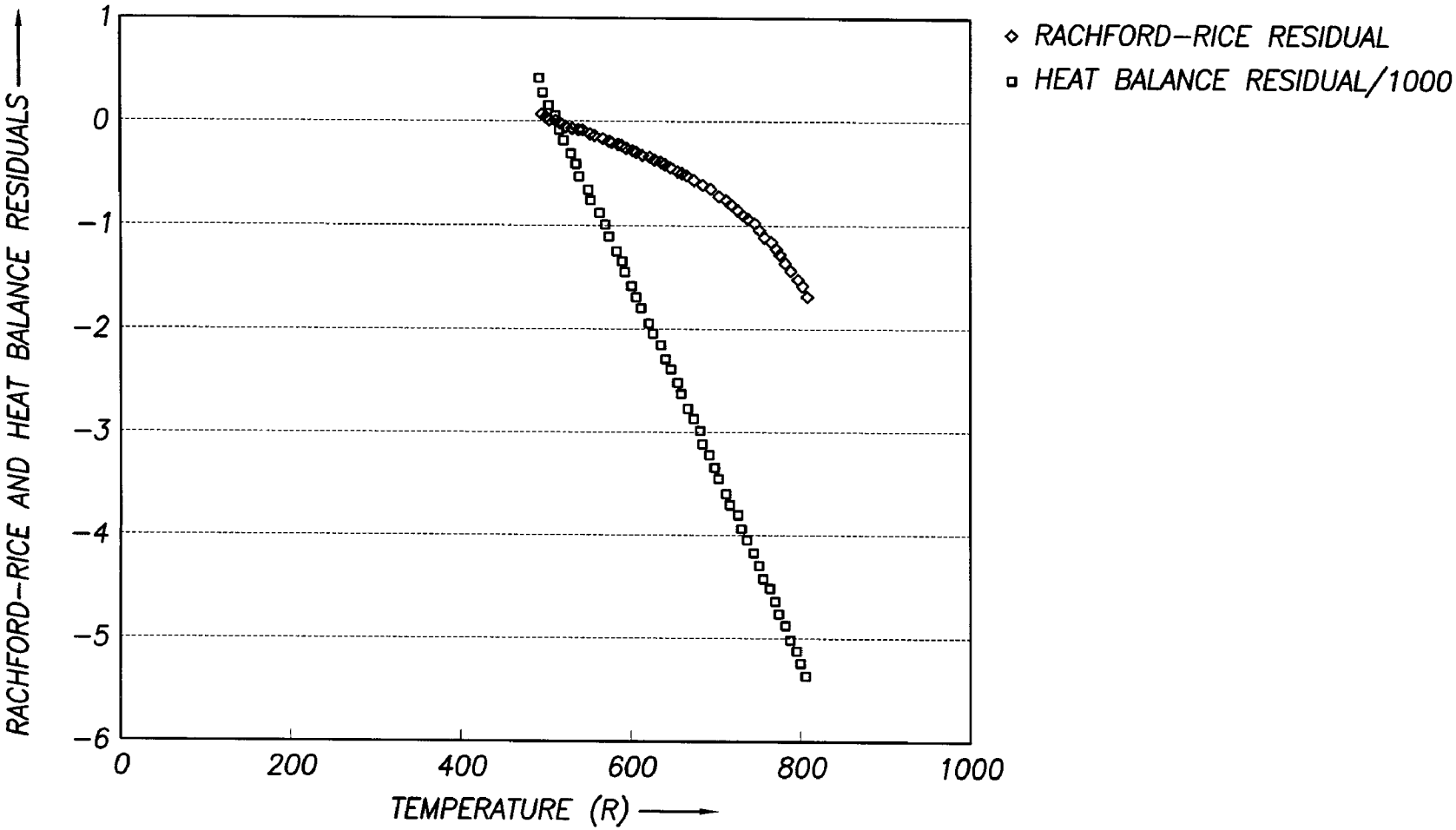

FIGS. 7 and 8 show plots of the VLE residuals (i.e., Vapor-Liquid-Equilibrium residuals or flash residuals) for this OWG (oil-water-gas) state solved from equations (26) and (27) for the two variables T and V. As shown in FIG. 7, the solution for the vapor split in this particular problem is V=3.1e-8 while in FIG. 8, the solution for the temperature in this particular problem is T=513.5 R where R represents Rankine. FIG. 7 shows the cause of difficulty in convergence because of sensitivity of the VLE residual to V. A maximum vapor split may be shown to be $$V \leq \frac{1 - Z_w}{1 - K_w}$$

and the high water feed $Z_w$ (e.g., 0.9999904) together with the fact that this state has a liquid phase are the reasons for the very low solution value (i.e., 3.1e-8) of V. In this case, the starting guess equation (30) (traces of low volatility hydrocarbons are present) is important to obtain quick convergence. This equation (30) often provides a good prediction for the OWG VLE calculation.

Figure 9:
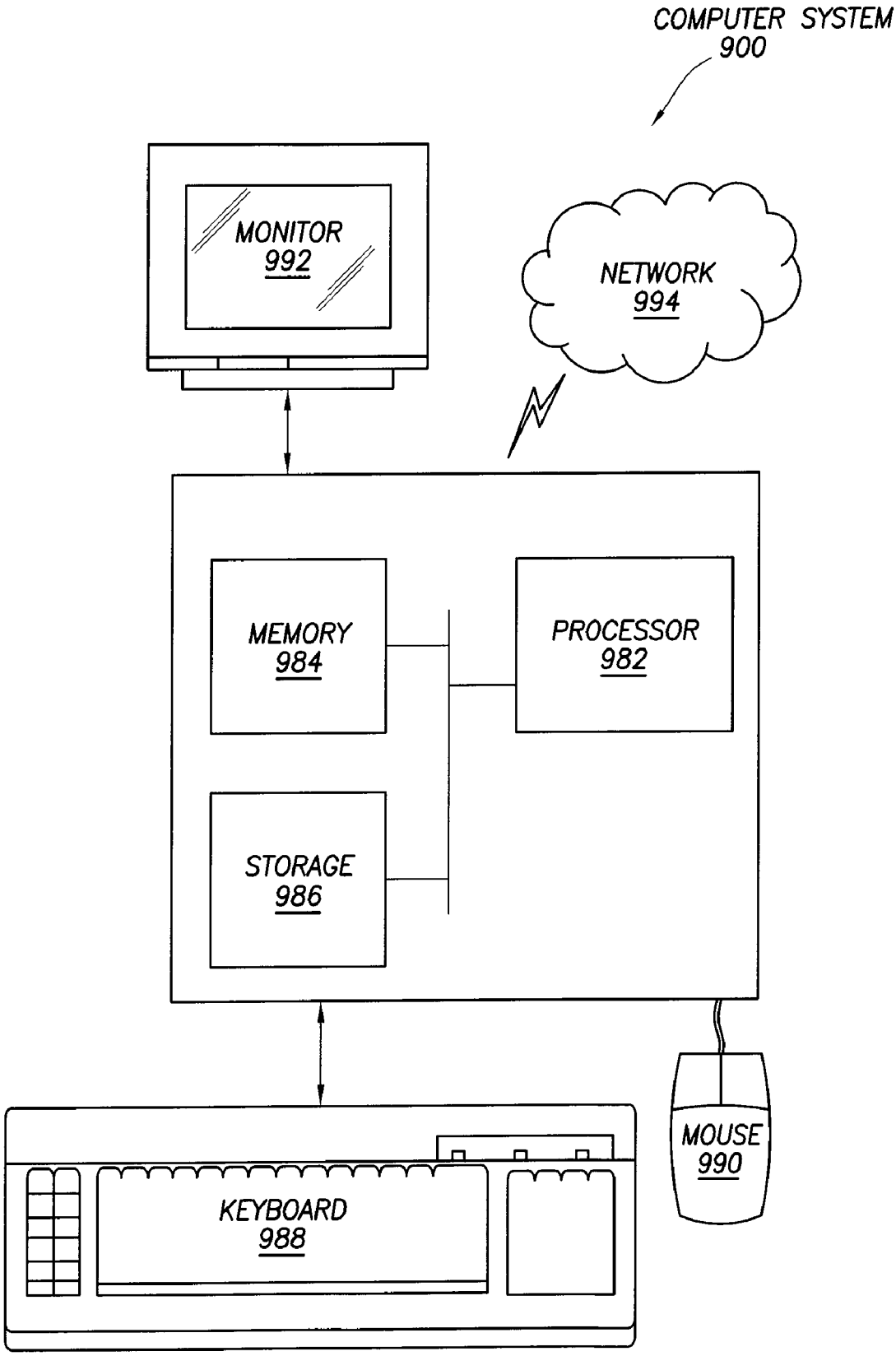
FIG. 9 shows a computer system in which embodiments of multi-component multi-phase fluid analysis using flash method can be implemented.

The multi-component multi-phase fluid analysis using flash method may be implemented on virtually any type of computer regardless of the platform being used. For example, as shown in FIG. 9, a computer system (900) includes a processor (982), associated memory (984), a storage device (986), and numerous other elements and functionalities typical of today's computer. The computer system (900) may also include input means, such as a keyboard (988) and a mouse (990), and output means, such as a monitor (992). The computer system (900) is connected to a local area network (LAN) (994) or a wide area network (e.g., the Internet) (994) via a network interface connection. Those skilled in the art will appreciate that these input and output means may take other forms.

Further, those skilled in the art will appreciate that one or more elements of the aforementioned computer system (900) may be located at a remote location and connected to the other elements over a network (994). Further, the multi-component multi-phase fluid analysis using flash method may be implemented on a distributed system having a plurality of nodes, where each portion of the multi-component multi-phase fluid analysis using flash method may be located on a different node within the distributed system. In one embodiment of the invention, the node corresponds to a computer system. Alternatively, the node may correspond to a processor with associated physical memory. The node may alternatively correspond to a processor with shared memory and/or resources. Further, software instructions to perform embodiments of the invention may be stored on a computer readable medium such as a compact disc (CD), a diskette, a tape, or any other computer readable storage device.

The systems and methods provided relate to acquisition of hydrocarbons from an oilfield. It will be appreciated that the same systems and methods may be used for performing subsurface operations, such as mining, water retrieval and acquisition of other underground materials. Further, the portions of the systems and methods may be implemented as software, hardware, firmware, or combinations thereof.

This description is intended for purposes of illustration and should not be construed in a limiting sense. The scope of this invention should be determined by the language of the claims that follow. The term "comprising" within the claims is intended to mean "including at least" such that the recited listing of elements in a claim are an open group. "A," "an" and other singular terms are intended to include the plural forms thereof unless specifically excluded.

While multi-component multi-phase fluid analysis using flash method has been described with respect to a limited number of embodiments, those skilled in the art, having benefit of this disclosure, will appreciate that other embodiments can be devised which do not depart from the scope of multi-component multi-phase fluid analysis using flash method as disclosed herein. Accordingly, the scope of multi-component multi-phase fluid analysis using flash method should be limited by the attached claims.

What is claimed is:

1. A method of analyzing phase transitions of fluid in an oilfield operation of an oilfield, comprising:

determining a plurality of phase boundaries of a multi-component multi-phase system based on a plurality of geophysical parameters associated with the oilfield, wherein the plurality of phase boundaries are determined by:

determining a first temperature at which a first liquid phase associated with the plurality of phase boundaries transitions by disappearing;

determining a second temperature at which a second liquid phase associated with the plurality of phase boundaries transitions by disappearing, wherein the first liquid is present when the second liquid disappears, wherein the second temperature is determined based on the first temperature and is lower than or equal to the first temperature; and determining a third temperature at which a gaseous phase transitions by appearing, wherein the third temperature is determined based on the second temperature and is lower than or equal to the second temperature, wherein determining the first, second, and third temperatures are by using pressure and temperature dependent empirical equilibrium multi-phase mole fraction ratios (K-values) of the multi-component multi-phase system;

wherein the plurality of phase boundaries are associated with a liquid oil phase, a liquid water phase, and a gaseous phase, and wherein the plurality of geophysical parameters comprises at least one selected from a group consisting of a mole fraction of a volatile hydrocarbon (vhc) component of oil, a mole fraction of a non-volatile hydrocarbon (nvhc) component of oil, a mole fraction of a non-condensable hydrocarbon (nchc) component of oil, a mole fraction of water, pressure of the fluid, and enthalpy of the fluid, in presence of a non-volatile hydrocarbon (nvhc), setting a phase transition enthalpy for a liquid phase to large number representing infinity;

in absence of a non-volatile hydrocarbon (nvhc), setting a phase transition enthalpy for a liquid phase based on a maximum of a determined first value of the first temperature as associated with water and a determined second value of the first temperature as associated with at least one volatile hydrocarbon (vhc) component;

predicting an amount of an at least one fluid component in a liquid fluid phase of the multi-component multi-phase system by solving a set of flash equations with a computer processor based on the plurality of phase boundaries; and performing the oilfield operation based on the predicted amount.

2. The method of claim 1, further comprising:

modeling the oilfield operation using at least one simulator, wherein at least an portion of the oilfield is represented by a plurality of grid blocks in the at least one simulator, wherein the plurality of phase boundaries are determined and the amount of oil in a liquid oil phase is predicted for each of the plurality of grid blocks.

3. The method of claim 2, further comprising:

determining a phase state, a phase split, and a phase mole fraction associated with each of the plurality of grid blocks.

4. The method of claim 1, wherein determining the first temperature comprises:

determining $T_w$ from $z_w=K_{,w}(T_w)$ , wherein $T_w$ represents the first value of the first temperature as associated with water, $z_w$ represents the mole fraction of water, and $K_w$ represents a pressure and temperature dependent empirical equilibrium K-value associated with water;

determining $T_o$ from $$\sum_{i\in vhc}\frac{z_i}{K_{io}(T_o)}=1,$$

wherein $T_o$ represents the second value of the first temperature as associated with at least one vhc component, $z_i$ represents the mole fraction of each respective vhc component of oil, and $K_{io}$ represents a pressure and temperature dependent empirical equilibrium K-value associated with each respective vhc component of oil; and determining the first temperature from $T_1=\max(T_w,T_o)$, wherein $T_1$ represents the first temperature.

5. The method of claim 4, wherein determining the second temperature comprises:

determining $T_2$ from $$\sum_{i\in vhc}x_i=1 \text{ and } x_i=\frac{z_i(1-K_w(T_2))}{K_{io}(T_2)(1-z_w)},\ i\in vhc \text{ if } T_1=T_w,$$

wherein $T_2$ represents the second temperature; and determining $T_2$ from $$0=-K_w(T_2)-\frac{z_{nvhc}K_w(T_2)}{z_w}+\sum_{i\in vhc}\frac{z_iK_w(T_2)(1-K_{io}(T_2))}{K_w(T_2)-z_w(1-K_{io}(T_2))}+\frac{z_{nvhc}K_w(T_2)}{K_w(T_2)-z_w} \text{ if } T_1=T_o,$$

wherein $z_{nvhc}$ represents the mole fraction of a nvhc component of oil.

6. The method of claim 5, wherein the third temperature is determined from $$K_w(T_3)+\frac{1}{(1-z_w)}\sum_{i\in vhc}K_{io}(T_3)\cdot z_i=1,$$

wherein $T_3$ represents the third temperature.

7. A system for analyzing phase transitions of fluid in an oilfield operation of an oilfield, comprising:

a processor; and memory having instructions when executed by the processor comprising functionality to:

represent at least a portion of the oilfield as a proxy model for simulation;

determine a plurality of phase boundaries based on a plurality of geophysical parameters associated with the fluid in the portion of the oilfield using pressure and temperature dependent empirical equilibrium multi-phase mole fraction ratios (K-values) of the fluid;

wherein the plurality of phase boundaries are associated with a liquid oil phase, a liquid water phase, and a gaseous phase, and wherein the plurality of geophysical parameters comprises at least one selected from a group consisting of a mole fraction of a volatile hydrocarbon (vhc) component of oil, a mole fraction of a non-volatile hydrocarbon (nvhc) component of oil, a mole fraction of a non-condensable hydrocarbon (nchc) component of oil, a mole fraction of water, pressure of the fluid, and enthalpy of the fluid, wherein, in presence of a non-volatile hydrocarbon (nvhc), a transition enthalpy for a liquid phase is set to large number representing infinity;

wherein, in absence of a non-volatile hydrocarbon (nvhc), a transition enthalpy for a liquid phase is set based on a maximum of a determined first value of a temperature as associated with water and a determined second value of the temperature as associated with at least one volatile hydrocarbon (vhc) component;

predict an amount of oil in a liquid oil phase in the portion of the oilfield by solving a set of flash equations based on the plurality of phase boundaries; and perform a simulation of the oilfield operation using the proxy model based on the prediction.

8. The system of claim 7, the instructions when executed by the processor further comprising functionality to:

determine a phase state, a phase split, and a phase mole fraction associated with the portion of the oilfield.

9. The system of claim 7, wherein the plurality of phase boundaries are determined by:

determining a first temperature at which a remaining liquid phase associated with the plurality of phase boundaries transitions by disappearing;

determining a second temperature at which at which a first liquid phase associated with the plurality of phase boundaries transitions by disappearing, wherein the second temperature is determined based on the first temperature and is lower than or equal to the first temperature; and determining a third temperature at which a gaseous phase transitions by appearing, wherein the third temperature is determined based on the second temperature and is lower than or equal to the second temperature, wherein determining the first, second, and third temperatures are by using pressure and temperature dependent empirical equilibrium K-values of the multi-component multi-phase system.

10. The system of claim 9, wherein determining the first temperature comprises:

determining $T_w$ from $z_w=K_w(T_w)$, wherein $T_w$ represents a first value of the first temperature, as associated with water, $z_w$ represents the mole fraction of water, and $K_w$ represents a pressure and temperature dependent empirical equilibrium K-value associated with water;

determining $T_o$ from $$\sum_{i\in vhc}\frac{z_i}{K_{io}(T_o)}=1,$$

wherein $T_o$ represents a second value of the first temperature, as associated with at least one vhc component, $z_i$ represents the mole fraction of each respective vhc component of oil, and $K_{io}$ represents a pressure and temperature dependent empirical equilibrium K-value associated with each respective vhc component of oil; and determining the first temperature from $T_1=\max(T_w,T_o)$, wherein $T_1$ represents the first temperature.

11. The system of claim 10, wherein determining the second temperature comprises:

determining $T_2$ from $$\sum_{i\in vhc}x_i=1 \text{ and } x_i=\frac{z_i(1-K_w(T_2))}{K_{io}(T_2)(1-z_w)},\ i\in vhc \text{ if } T_1=T_w,$$

wherein $T_2$ represents the second temperature; and determining T, from $$0=-K_w(T_2)-\frac{z_{nvhc}K_w(T_2)}{z_w}+\sum_{i\in vhc}\frac{z_iK_w(T_2)(1-K_{io}(T_2))}{K_w(T_2)-z_w(1-K_{io}(T_2))}+\frac{z_{nvhc}K_w(T_2)}{K_w(T_2)-z_w} \text{ if } T_1=T_o,$$

wherein $z_{nvhc}$ represents the mole fraction of a nvhc component of oil.

12. The system of claim 11, wherein the third temperature is determined from $$K_w(T_3)+\frac{1}{(1-z_w)}\sum_{i\in vhc}K_{io}(T_3)\cdot z_i=1,$$

wherein $T_3$ represents the third temperature.

13. The system of claim 7, wherein the portion of the oilfield comprises at least one selected from a group consisting of wellsite, gathering network, process facility, and reservoir.

14. A computer readable storage non-transitory storage medium, embodying instructions executable by a computer for analyzing phase transitions of a multi-component multi-phase system, comprising:

determining a plurality of phase boundaries based on a plurality of parameters associated with the multi-component multi-phase system;

determining a phase state, a phase split, and a phase mole fraction based on the plurality of phase boundaries; and storing the phase state, the phase split, and the phase mole fraction in a repository, wherein the plurality of phase boundaries are determined by:

determining a first temperature at which a remaining liquid phase associated with the plurality of phase boundaries transitions by disappearing;

determining a second temperature at which a first liquid phase associated with the plurality of phase boundaries transitions by disappearing, wherein the second temperature is determined based on the first temperature and is lower than or equal to the first temperature; and determining a third temperature at which a gaseous phase transitions by appearing, wherein the third temperature is determined based on the second temperature and is lower than or equal to the second temperature, wherein determining the first, second, and third temperatures are by using pressure and temperature dependent empirical equilibrium multi-phase mole fraction ratios (K-values) of the multi-component multi-phase system wherein the plurality of phase boundaries are associated with a liquid oil phase, a liquid water phase, and a gaseous phase, and wherein the plurality of geophysical parameters comprises at least one selected from a group consisting of a mole fraction of a volatile hydrocarbon (vhc) component of oil, a mole fraction of a non-volatile hydrocarbon (nvhc) component of oil, a mole fraction of a non-condensable hydrocarbon (nchc) component of oil, a mole fraction of water, pressure of the fluid, and enthalpy of the fluid, wherein, in presence of a non-volatile hydrocarbon (nvhc), setting a phase transition enthalpy for a liquid phase to large number representing infinity;

wherein, in absence of a non-volatile hydrocarbon (nvhc), setting a phase transition enthalpy for a liquid phase based on a maximum of a determined first value of the first temperature as associated with water and a determined second value of the first temperature as associated with at least one volatile hydrocarbon (vhc) component.

15. The computer readable non-transitory storage medium of claim 14, wherein determining the first temperature comprises:

determining $T_w$ from $z_w=K_w(T_w)$, wherein $T_w$ represents a first value of the first temperature as associated with water, $z_w$ represents the mole fraction of water, and $K_w$ represents a pressure and temperature dependent empirical equilibrium K-value associated with water;

determining $T_o$ from $$\sum_{i\in vhc}\frac{z_i}{K_{io}(T_o)}=1,$$

wherein $T_o$ represents a second value of the first temperature as associated with at least one vhc component, $z_i$ represents the mole fraction of each respective vhc component of oil, and $K_{io}$ represents a pressure and temperature dependent empirical equilibrium K-value associated with each respective vhc component of oil; and determining the first temperature from $T_1=\max(T_w,T_o)$, wherein $T_1$ represents the first temperature.

16. The computer readable non-transitory storage medium of claim 15, wherein determining the second temperature comprises:

determining $T_2$ from $$\sum_{i\in vhc}x_i=1 \text{ and } x_i=\frac{z_i(1-K_w(T_2))}{K_{io}(T_2)(1-z_w)},\ i\in vhc \text{ if } T_1=T_w,$$

wherein $T_2$ represents the second temperature; and determining $T_2$ from $$0=-K_w(T_2)-\frac{z_{nvhc}K_w(T_2)}{z_w}+\sum_{i\in vhc}\frac{z_iK_w(T_2)(1-K_{io}(T_2))}{K_w(T_2)-z_w(1-K_{io}(T_2))}+\frac{z_{nvhc}K_w(T_2)}{K_w(T_2)-z_w}\text{ if } T_1=T_o,$$

wherein $z_{nvhc}$ represents the mole fraction of a nvhc component of oil.

17. The computer readable non-transitory storage medium of claim 16, wherein the third temperature is determined from $$K_w(T_3)+\frac{1}{(1-z_w)}\sum_{i\in vhc}K_{io}(T_3)\cdot z_i=1,$$

wherein $T_3$ represents the third temperature.

* * * * *